United States Patent [19]

Hildebrand et al.

[11] 4,340,845

[45] Jul. 20, 1982

[54] STABILIZED CATHODE ASSEMBLY FOR ARC LIGHT SOURCE

[75] Inventors: Karl J. Hildebrand, Tyngsboro; John Leeman, Andover, both of Mass.

[73] Assignee: Leeman Labs, Inc., Tewksbury, Mass.

[21] Appl. No.: 169,288

[22] Filed: Jul. 16, 1980

[51] Int. Cl.[3] ..... H01J 1/02

[52] U.S. Cl. ..... 315/327; 313/343; 315/357; 250/426

[58] Field of Search ..... 315/327, 357; 313/343, 313/351; 250/423 R, 425, 426, 427, 281; 219/121 P

[56] References Cited

U.S. PATENT DOCUMENTS

| | | | |
|---|---|---|---|
| 837,277 | 0/1906 | Birkeland et al. | 315/357 |
| 1,678,574 | 7/1928 | Niemeyer | 315/327 |
| 3,746,905 | 7/1973 | Shelton et al. | 313/309 |
| 3,864,579 | 2/1975 | Hashmi et al. | 250/425 |
| 4,060,708 | 11/1977 | Walters | 250/425 |
| 4,267,484 | 5/1981 | O'Loughlin | 313/309 |

*Primary Examiner*—Harold A. Dixon
*Attorney, Agent, or Firm*—John M. Brandt

[57] ABSTRACT

A stabilized cathode assembly for an arc light source is disclosed wherein an unattached end of a length of electrically conducting braid serving as a cathode is held in close proximity to the anode of the source to establish an arc path between the braid end and the anode. Support means are disclosed which function to advance and withdraw the braid to initiate the arc. Application of the assembly in a spectrometer sample excitation device is further disclosed.

12 Claims, 5 Drawing Figures

STABILIZED CATHODE ASSEMBLY FOR ARC LIGHT SOURCE

BACKGROUND OF THE INVENTION

1. Field of the Invention

The invention resides in the field of arc light sources and particularly relates to cathode assemblies for such sources.

2. Description of the Prior Art

Arc lights wherein an electrical discharge takes place in a gap between an anode and cathode are well known in the prior art. In many cases, the stability of the arc path in these lights is of little consequence. However, in some applications, particularly spectrometers, path continuity and uniformity is important for accurate measurements.

In such spectrometers, electrical discharge devices of various types are used to vaporize and excite samples for optical analysis. Among these devices is the direct current plasma arc which is favored for its high degree of sensitivity and simplicity of construction. A major drawback of this discharge technique in spectrometers is a relative lack of stability which is reflected in imprecision of analytical results.

A primary cause of this instability is the tendency of the discharge at the cathode electrode to wander over the surface of the electrode tip. This wander around the tip is seen as a shifting in the position of the arc path or column. The most common attempt to overcome this difficulty has been to use a sharply pointed electrode of reduced cross-section, typically about 0.040 inches. This reduces but does not completely eliminate the problem. Further, the use of a small cross-section requires an electrode material with a very high melting temperature, such as tungsten alloys. These metals result in additional problems. Tungsten, for example, upon excitation emits at approximately 4000 separate wavelengths in the popular and analytically useful region of 2000–6000 A°. This substantially increases the probability of spectral interferences in the analytical result.

Other solutions involve controlling the flow of a current conducting inert gas plasma in the arc path in a manner that mechanically restricts the shape of the gas column such that it will not reflect changes in the position of the cathode discharge. This technique is disclosed in U.S. Pat. No. 4,060,708 by J. P. Walters. In contrast to the prior art, the present invention solves the problem of arc path wander by the use of a unique cathode assembly as disclosed below.

SUMMARY OF THE INVENTION

The invention may be summarized as a cathode assembly for an arc light source consisting of a length of electrically conducting braid having an unattached, exposed end transverse the longitudinal axis of the braid, and means for holding that end in close proximity to the anode of the source. Use of the braid an positioning it in the manner described results in the establishment of an arc path between the anode and the tip of each of the interwoven fibers which comprise the braid. The complete arc path is therefore a composite of each of the individual paths.

The invention may further include means to advance the braid into contact with the anode to strike the arc and then to withdraw the braid to establish the arc path.

Additionally, an anode comprised of a braid, similar to that of the cathode, is contemplated.

This apparatus is particularly applicable to spectrometers and the preferred embodiment and drawings will be shown and described in that context.

DESCRIPTION OF THE PREFERRED EMBODIMENT

Figure 1:
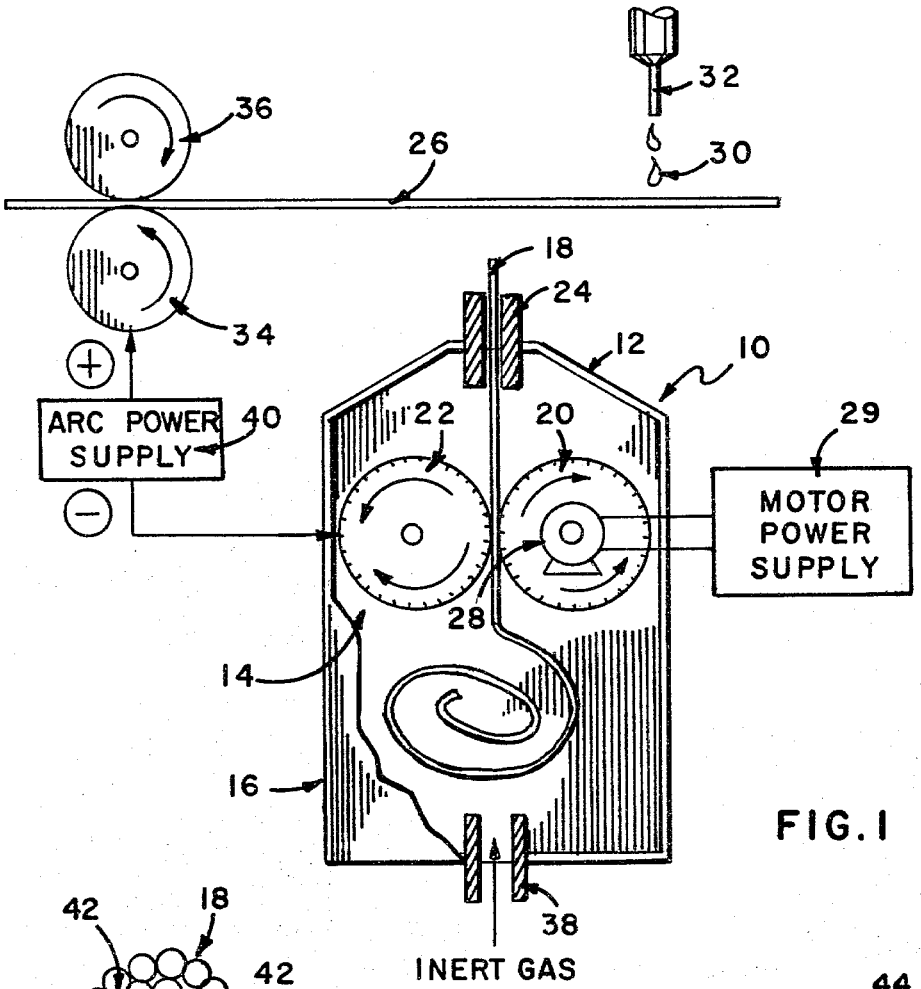
FIG. 1 is a cutaway, partially schematic illustration of the preferred embodiment.

Referring to FIG. 1, a cathode assembly for an arc light source constituting the preferred embodiment of the invention is illustrated. Chamber 10 is composed of side 12, back pate 14, and front plate 16 shown cut away to expose the internal construction of the assembly. Cathode 18, consisting of a length of electrically conducting braid comprised of, for example, one hundred strands of graphite each approximately 0.007 millimeters in diameter, is contained in chamber 10. The braid passes between knurled wheels 20 and 22 and extends out of the chamber through pipe 24. The cathode may be advanced toward or retracted from anode 26 by rotation of the wheels activated, for example, by reversable electrical motor 28, shown schematically and powered by supply 29.

The anode may take a variety of forms, Anode 26 consists of a length of electrically conducting graphite braid similar to that of the cathode. The anode is arranged to receive and hold in the manner of a wick a liquid sample 30 dispensed from pipe 32 for spectrometric analysis. The anode is drawn past the cathode by rollers 34 and 36, driven by means not shown, to expose successive portions of the sample to excitation by the arc created between the anode and the cathode. As is well known in spectrometric practice, the arc is preferably maintained in an inert atmosphere such as argon. The gas may be introduced into the chamber under pressure through pipe 38 and forms an envelope about the arc upon exciting from pipe 24.

Power for the arc is supplied by power supply 40 connected to roller 34 and wheel 22. The roller and wheel are electrically conductive and transmit power to the anode and cathode respectively. To strike the arc, the cathode is advanced to contact the anode and the withdrawn by rotation of wheels 20 and 22. Withdrawal ma be accomplished automatically by measuring the resistance between the anode and cathode and initiating the retraction when the resistance reaches zero.

Figure 2:
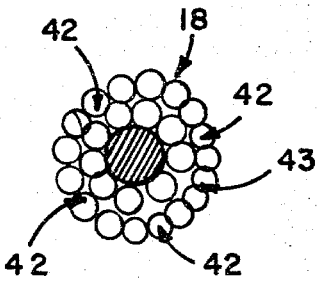
FIG. 2 is a greatly enlarged cross-sectional view of the cathode of FIG. 1.
Figure 3:
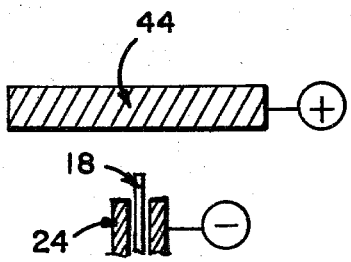
FIG. 3 is an illustration of an alternative construction of the anode of FIG. 1.

Referring to FIG. 2, an enlarged cross-section of the braid is shown illustrating individual fibers 42, wrapped about core 43. Each fiber acts as a separate point cathode such that the arc path is a composite of the individual paths between the anode and each fiber. Wandering of the path about the cathode is therefore almost completely eliminated since each individual path is essentially continuous and separate from all of the others.

Figure 4:
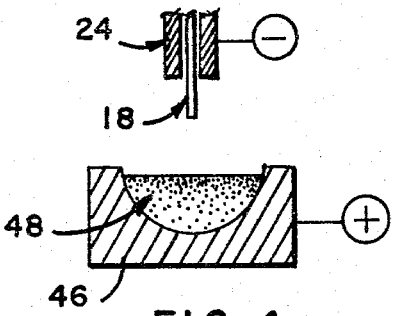
FIG. 4 is an illustration of an additional alternative construction of the anode of FIG. 1.
Figure 5:
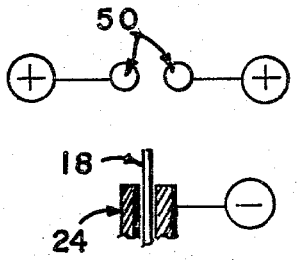
FIG. 5 is an illustration of a further alternative construction of the anode of FIG. 1.

Referring to FIGS. 4, 5, and 6, alternative anode embodiments for use with the invention in spectrometers are illustrated. In FIG. 4, a solid sample 44, such as a block of metal, comprises the entire anode. FIG. 5 shows a cup anode 46 for containing a powdered sample 48. FIG. 6 illustrates the use of two braids shown cross-sectinally as dual anodes 50. The employment of this configuration provides an arc path and excitation region which is a composite of the individual paths and is therefore an average of the results which would be obtained from each of the individual anodes and their respective samples.

What is claimed is:

1. In an arc light source comprised of an anode, a cathode, and a direct current power supply connected between said anode and said cathode, a stabilized cathode assembly comprising in combination:

a. a cathode comprising a length of electrically conducting braid consisting of a bundle of interwoven electrically conducting fibers, said braid having an unattached end transverse the longitudinal axis of said braid; and b. cathode support means arranged to position said unattached end of said braid in close proximity to said anode whereby an arc path is established between said end and said anode.

2. The apparatus of claim 1 wherein said cathode support means further comprises means to advance said unattached end into contact with said anode and to subsequently withdraw said end from said anode to initiate an arc between said anode and said cathode.

3. The apparatus of claim 1 wherein said anode comprises a length of electrically conducting braid consisting of a bundle of interwoven, electrically conducting fibers, the longitudinal axis of said anode positioned transverse the longitudinal axis of said cathode.

4. The apparatus of claim 1 or 3 wherein said fibers are comprised of graphite.

5. A sample excitation device for spectrometers comprising in combination:

a. an anode;

b. a cathode comprising a length of electrically conducting braid consisting of a bundle of interwoven electrically conducting fibers, said braid having a unattached end transverse the longitudinal axis of said braid;

c. cathode support means arranged to position said unattached end of said braid in close proximity to said anode, whereby an arc path is established between said end and said anode;

d. direct current electrical power supply means connected to said anode and said cathode; and e. gas supply means for introducing a stream of inert gas about said cathode and into said arc path.

6. The apparatus of claim 5 wherein said cathode support means further comprises means to advance said unattached end into contact with said anode and to subsequently withdraw said end from said anode to initiate an arc between said anode and said cathode.

7. The apparatus of claim 5 wherein said anode comprises said sample.

8. The apparatus of claim 5 wherein said anode is arranged to support said sample.

9. The apparatus of claim 8 wherein said anode comprises a cup arranged to hold said sample.

10. The apparatus of claim 8 wherein said anode comprises a length of electrically conducting braid consisting of a bundle of interwoven, electrically conducting fibers, the longitudinal axis of said braid positioned transverse the longitudinal axis of said cathode.

11. The apparatus of claim 8 wherein said anode comprises a pair of closely spaced, parallel lengths of electrically conducting braid each consisting of a bundle of interwoven electrically conducting fibers, the longitudinal axis of said braids positioned transverse the longitudinal axis of said cathode.

12. The apparatus of claims 10 or 11 wherein said fibers are comprised of graphite.

* * * * *